United States Patent [19]

Gosis

[11] Patent Number: 4,860,498

[45] Date of Patent: Aug. 29, 1989

[54] AUTOMATIC WORKPIECE THICKNESS CONTROL FOR DUAL LAPPING MACHINES

[75] Inventor: Anatoly Gosis, Palatine, Ill.

[73] Assignee: General Signal Corp., Stamford, Conn.

[21] Appl. No.: 231,969

[22] Filed: Aug. 15, 1988

[51] Int. Cl.[4] ..... B24B 49/00

[52] U.S. Cl. ..... 51/165.77; 51/131.4

[58] Field of Search ..... 51/165.77, 165.81, 165.83, 51/165.88, 165.91, 165.74, 111 R, 117, 131.3, 131.4

[56] References Cited

U.S. PATENT DOCUMENTS 3,395,494 8/1968 Sogn ..... 51/131.4
4,359,840 11/1982 Bryner ..... 51/131.4
4,524,547 6/1985 Heaston et al. ..... 51/165.77

FOREIGN PATENT DOCUMENTS 188671A 8/1987 Japan ..... 51/131.4

*Primary Examiner*—Frederick R. Schmidt
*Assistant Examiner*—Maurina Rachuba

[57] ABSTRACT

A device for automatically sizing (thickness control) a workpiece of a double wheeled lapping machine, during the lapping process with simultaneous runout of the lower lap compensation. The device provides an annular ring attached in parallelism to the upper plate, together with a roller follower having contact with the under surface of the ring, with the follower pivoted upon an adjustable mounting arm attached to a vertically extending stationary post mounted beyond the circumference of the ring on a supporting shelf formed as a part of the machine casing. A movement responsive probe is in contact with the follower and responds to any deviation in flatness of the workpiece as it is transmitted therefrom onto the lapping surfaces of dual lap plates during the lapping thereof.

15 Claims, 4 Drawing Sheets

| STATUS | PLATE MOVED | PROBE MOVED A | PROBE MOVED B | DISPLAYED A+B |
|---|---|---|---|---|
| NO RUNOUT | T | .5T | .5T | .5T + .5T = T |
| RUNOUT "R" | T ± R | .5(T ± R) | .5(T ∓ R) | .5T ± .5R + .5T ∓ .5R = T |

AUTOMATIC WORKPIECE THICKNESS CONTROL FOR DUAL LAPPING MACHINES

SUMMARY OF THE INVENTION

An apparatus to control the finished thickness of workpieces during the lapping process. The apparatus uses a two probe system wherein the probes are designed to respond to the continuing reducing thickness of the workpiece to electrically control the continuing operation of the lapping process.

The system utilizes two pressure probes which are of a standard commercially available type and which are in circuit with the power source of the lapping machine. The system also embodies a visual adjustable readout display which together with the probes and the original circuitry of the lapping machine make up no part of this invention except for their needed presence in the total operating machine's environment.

As hereinafter described the system consists of two probes installed in novel stationary housings. The probes are adapted to be activated by pivotal levers carried within the stationary housing, with each lever providing at its respective free end, a cam-like roller follower. The cam followers are adjustable positioned so as to be in rolling contact with a responsive workpiece sizing member adjustably attached circumferentially and in parallelism with respect to the rotating upper lap plate.

When the lever actuated probes are preset they will upon responding to the desired predetermined thickness of the workpiece being lapped, interrupt the lapping process. The system takes into consideration runout and compensates for it.

BACKGROUND OF THE INVENTION

Past apparatuses attempting to produce an automatic sizing function for lapping machines were deficient in that they required constant monitoring and frequent replacement of cooperating components.

For example prior devices provided for stationary probes extending in an upward direction with the sensing tip of the probe periodically contacted by an actuating arm which in turn was physically attached to the rotating upper plate. This arrangement required a fixed attachment of the actuating member to the plate, with such attachment requiring extreme tolerances such that the fixed member be assembled and permanently maintained in parallelism to the lapping surface. As the sensing tip of the probe was successively struck by the rotating independent actuating arm, it became worn and/or deformed such that it did not function accurately. As the sensing probe was in direct displacement with respect to the fixed actuating aem such probe would be rendered inoperative when and if the lap was lowered beyond its normal operating plane i.e. a plane determined by the presence of a workpiece superimposed between the upper and lower lapping surfaces.

The present invention overcomes these deficiencies by providing a ring-like actuating member which has continuous rolling contact with a probe actuating lever. By this arrangement the probe is disposed in a downwardly directed probing direction with the actuating lever being restricted in its degree of rotation about its pivot point irregardless of the displacement of the lapping surface such that the probe cannot be damaged or rendered ineffectual regardless of the extreme positioning of the upper lap plate.

DESCRIPTION OF THE DRAWINGS

The invention will be best understood by reference to the accompanying drawings illustrating the preferred form of construction and mode of operation by which the stated objects of the invention are achieved and in which.

GENERAL DESCRIPTION OF THE INVENTION

Figure 1:
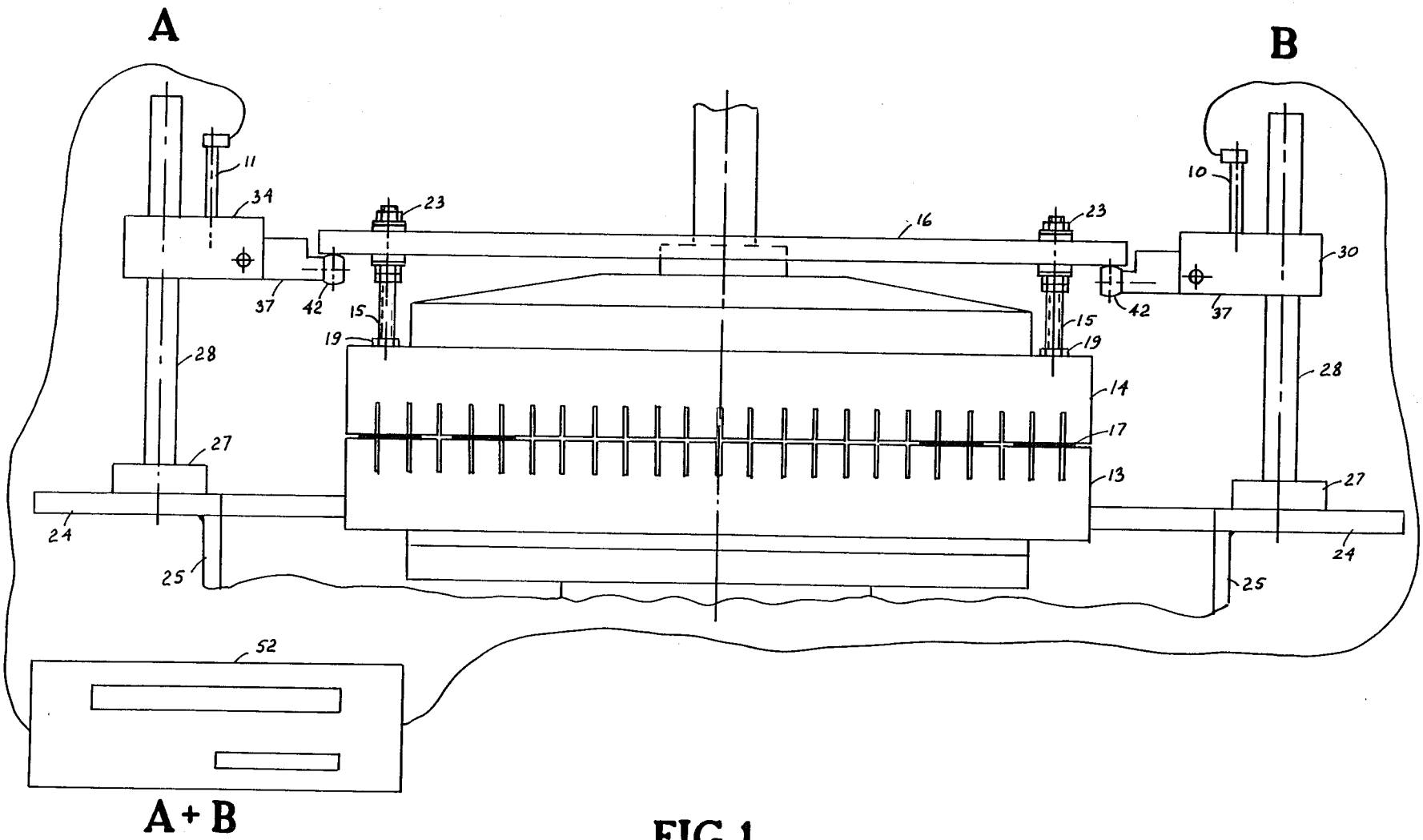
FIG. 1 is a fragmentary side elevational view of the invention showing the parts in relation to each other and schematically illustrating a readout display unit.

The autosizing structure of this invention may be installed on original equipment or used as a modifying kit assembly for existing double lap machines. The structure utilizing a set of wear compensating probes 10 and 11 as shown in FIG. 1. As each of these probes are structurally identical, thus only one will be described in detail in the following text.

As illustrated in FIG. 1 the dual lapping machine 12 consists of a lower lap plate 13 and a upper lap plate 14. Fixedly attached to the upper lap plate 14 by series of adjustable studs 15 is a control ring 16. It is vital to the operation of the mechanism of this invention that the control ring 16 be mounted concentrically and in perfect parallelism to the lap surface 17 of the upper lap plate 14.

To achieve the desired relation between the ring 16 and the upper plate 14 a series of studs 15 are threaded into tapped holes 18 formed in the upper surface of the upper lap plate 14. To assure a secured connection between the ring 16 and the plate 14 it is suggested that a series of twelve 12 studs 15, equally distant about the circumference of the plate 14, be employed.

Figure 2:
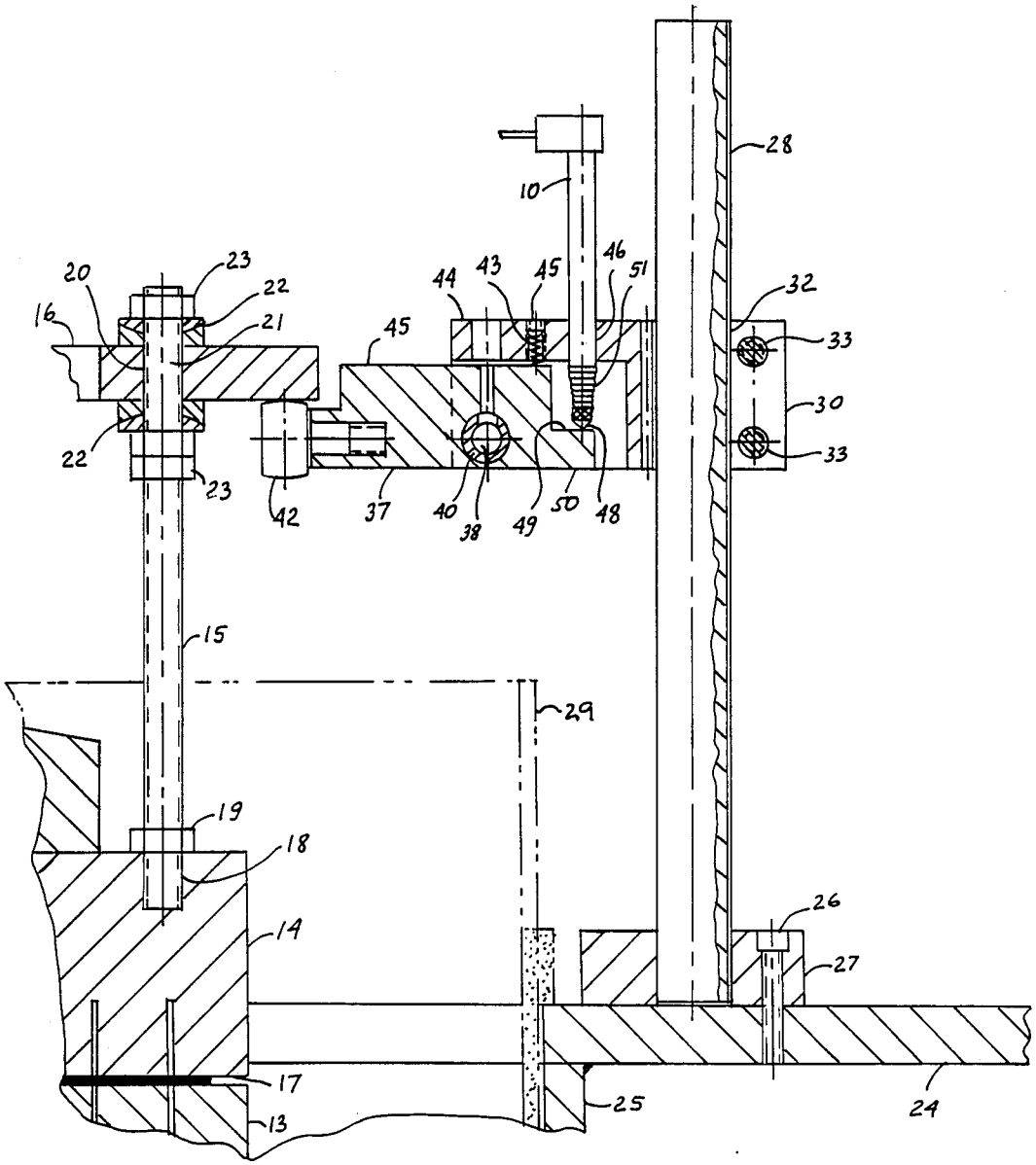
FIG. 2 is a fragmentary sectional view of the invention.

Referring to FIG. 2 wherein it is shown that the stud 15 has been threaded into a hole 18 and by jam nut 19 is secured therein. The ring 16 has formed therein a receiving opening 20 for the upper extension 21 of the stud 15. To either side of the ring 16 in alignment with the opening 20 formed therein and slidably positioned upon the extension 21 of the stud 15 are a pair of spherical washers 22. These washers 22 are held in place by suitable jam nuts 23. The final tightening of the jam nuts 23 against the washers 22 is achieved after suitable parallelism tests are performed between the ring 16 and the plane of the facial contact between the working surfaces of the upper and lower lap plates 13 and 14.

Cooperating with the control ring 16 are the two measuring assemblies including the probes 10 and 11. As shown in FIG. 2 the measuring assemblies are adapted to be mounted on a shelf 24 extending about the outer casing 25 of the lapping machine. By a suitable bolt 26 a mounting block 27 is positioned upon the shelf 24 with the block 27 supporting a vertically extending post 28 positioned exteriorly of the splash guard 29 provided by the machine which extends circumferentially beyond the upper and lower lap plates 13 and 14.

Slideably mounted upon the post 28 is a probe housing 30. This housing 30 provides an end portion slotted as at 31 with the slot having communication with the center opening 32 formed in the housing 30 through which the post 28 freely projects. The slotted end portion of the housing 30 can be securly clamped in any horizontally adjusted position upon the post 28 by a set of clamping screws 33.

Figure 3:
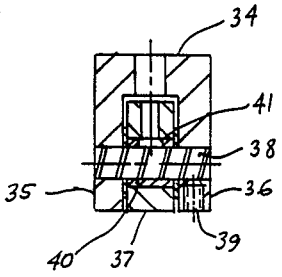
FIG. 3 is a fragmentary detailed sectional view showing a pivotal connection between selective parts of the structure of the invention.

The housing 30 provides a laterally projecting hollow support arm 34. Adapted to be positioned within the hollow arm 34 between the wall sections 35 and 36 thereof is a pivot lever 37. This pivot lever 37 if freely mounted upon a pivot pin 38 which extends between wall sections 35 and 36 of the support arm 34 as shown in FIGS. 2 and 3. A set screw 39 firmly retains the pivot 38 in place. A bushing 40 is placed upon the pin 38 and is received in a suitable opening 41 formed in the pivot lever 37. This bushing 40 may be conveniently lubricated through aligned access openings formed in the respective parts as clearly seen in FIG. 3.

The outer end of the pivot lever 37 supports a roller follower 42 which in its operative position has rolling contact with the under surface of the control ring 16. To yieldably maintain the follower 42 in such rolling contact with the ring 16, a tension spring 43 is carried by the top wall 44 of the support arm 34 as shown in FIG. 2. By a threaded cap 45 the spring 43 is held in yieldable contact with the top wall surface 45 of the pivot lever 37 to the inboard side of the pivot pin 38.

Figure 4:
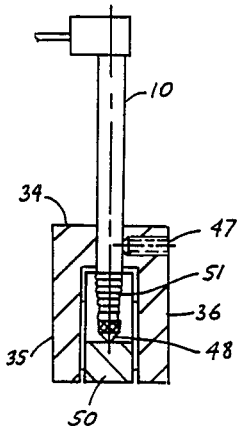
FIG. 4 is a detailed sectional view showing a probe connection as utilized in the invention.
Figure 5:
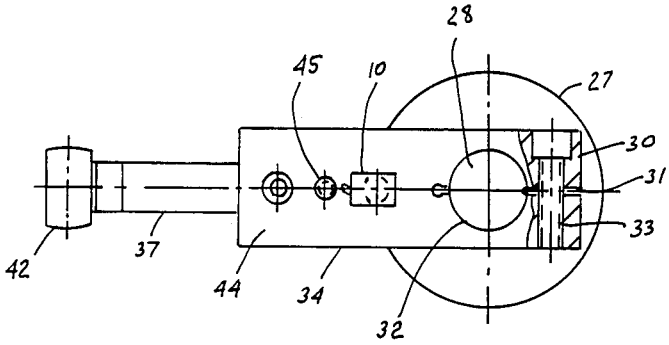
FIG. 5 is a fragmentary detailed top sectional view of a portion of the invention.

As shown in FIG. 2 the probe 10 extends through an opening 46 formed in the top wall 44 of the support arm 34. A suitable set screw 47 secures the probe 10 in place as clearly shown in FIG. 4. The probe 10 includes an internal slideable arm, not shown, the pressure tip 48 of which contacts the surface 49 of an internal shoulder 50 provided by the pivot lever 37. The pressure tip 48, as well as its internal moveable pin, is protected by a bellows 51 as shown.

To condition the autosizing assembly for proper operation the lapping plates 13 and 14 should be conditioned to the flatness necessary for a proper lapping operation with the lower plate 13 having a runout of 0.003 inches maximum. With the upper plate 14 resting on the lower plate 13 with minimal pressure, rotate the upper plate so as to position one of its studs 15 in alignment with the roller 42. The probe 10 should indicate an adjusted zero on the appropriate display unit 52. After marking the intitial stud 15 rotate the upper plate against the stationary lower plate until the upper plate 14 has been rotated 120 degrees. The visual display unit 52 should again indicate zero and if it does not then the control ring 16 must be adjusted vertically on the stud 15 which is now opposite the roller 42. The process can be repeated by rotating the upper plate 14 an additional 120 degrees until the proper profile of the control ring 16 is achieved. It is important to bear in mind that the probe housing 34 as it is supported on post 28 must extend radially from the center of rotation of the upper plate 14. Correctly marking this location permits the housing 34 to be conveniently relocated with respect thereto as necessary.

To prepare the machine for a lapping operation, the probe housings 34 are rotated about their respective supporting posts 28 to a position clear of the ring 16 and upper lapping plate 14. The upper plate 14 is then elevated such that the workpieces to be sized may be placed on the lower lap plate 13. After the upper plate 14 has been lowered into contact with the workpieces the probe housings 34 are then relocated and repositioned so that the roller followers 42 are in contact with the under surface of the control ring 16.

After each lapping operation, the upper and lower lap plates should be monitored for wear, and the vertical positioning of the probe housings 34 should be made as soon as it is indicated that a wear of 0.031 for each plate is detected.

The successful autosizing of workpieces is the result of the following specific structure and their functions: To increase the sensitivity of the probe action it is desirable to have a 2:1 ratio in the pivotal action of the pivot lever 37. This is accomplished by having the lever offset to either side of its pivot pin 39 in a 2:1 length relation as shown in FIG. 2.

Figure 6:
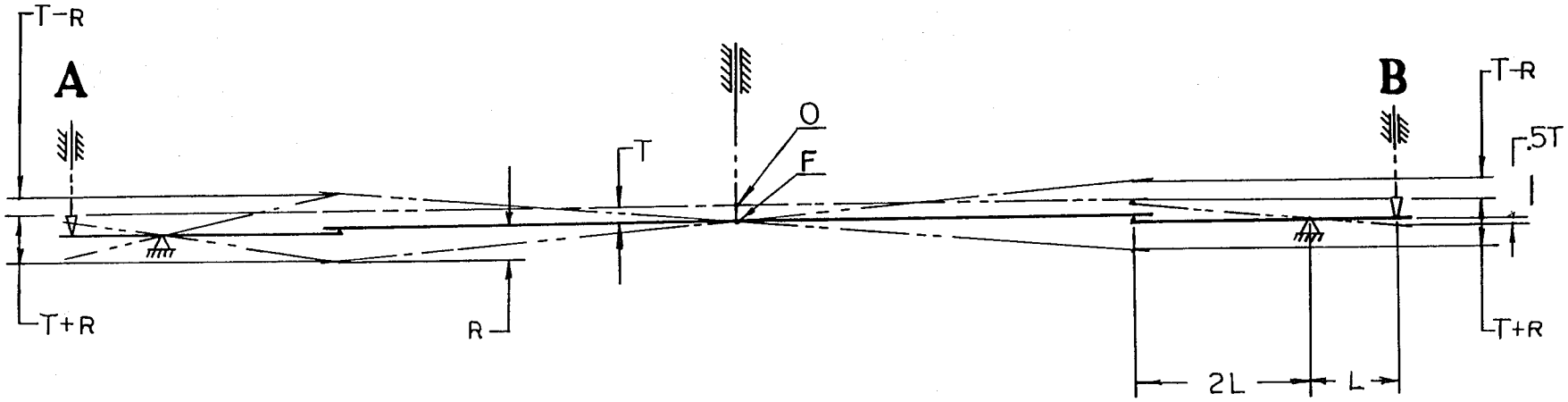
FIG. 6 is a schematic diagram illustrating the resulting function and operation of the invention.

FIG. 6 schematically illustrates the computation resulting from the operation of the sizing apparatus of this invention.

In FIG. 6 the original starting center point for the upper lap plate is indicated at "O". The letter "T" represents the thickness of the plate and the letter "F" indicates the projected finished position of the center point of the lap.

The indicia "2L" and "L" illustrate the 2:1 pivotal movement of the lever. The letter "R" indicates the runout of the lapping surface. The responding probes are indicated at "A" and "B".

Thus in the example where there is no runout experienced, both probe "A" and "B" will record a thickness of 0.5T and the resulting display of the position of probes "A" and "B", resulting from the equation $0.5T+0.5T$, will equal "T" the thickness of the workpiece.

In the event that runout is experienced the lap plate will move the equivalent of "T"±"R". In this situation probe "A" and "B" will register $0.5(T\pm R)$. The display of probe "A" and "B" will then indicate "T" as the product of $0.5T(\pm 0.5R)+0.5t(\pm 0.5R)$.

Thus by effecting a 2:1 actuating ratio a highly sensitive continuing determination of the thickness of the workpiece is achieved. This achievement recognizes and continuously comensates for normal plate runout.

In order to protect the probes against accidental damage, it should be noted that the pivotal action of the lever 37 in either direction is physically limited. As an example the lever 37 as viewed in FIG. 2 is limited in its clockwise direction by the engagement of its top wall surface 45 with the extreme outer corner edge of the top wall 44 of the hollow arm 34. Limiting the pivotal movement of the lever 37 in a counterclockwise direction results when the inner corner of the top wall 45 of the lever engages the under side of the top wall 44 of the hollow arm 34.

Having thus described my invention what I claim as new and desire to protect by Letters Patent is:

1. An automatic sizing apparatus for workpieces being lapped by a machine having rotatable upper and lower lap plates comprising, (a) a responsive workpiece sizing means attached to the upper lap plate for rotation therewith, (b) means for adjustably connecting said responsive workpiece sizing means concentrically of and in parallelism to the upper lap plate, (c) a workpiece sizing assembly including means for continuously indicating the thickness of the workpiece during the lapping operation, (d) means for adjustably supporting said workpiece sizing assembly circumferentially of and in radial relation to said responsive workpiece sizing means, (e) said workpiece sizing assembly including a pivotal lever, one end of which supports a means in contact with said responsive workpiece sizing means with its opposite end adapted to engage and actuate a sensing probe, (f) a sensing probe carried in a fixed position relative to said lever and including a moveable element in contact with and moveable in response to any pivotal movement of said lever, and (g) means for pivotally connecting said lever to said workpiece sizing assembly.

2. An automatic sizing apparatus as defined by claim 1 wherein said responsive workpiece sizing means comprises an annular ring having a diameter greater than the upper lap plate so as to extend circumferentially of and in spaced relation to the annular edge of the upper lap plate.

3. An automatic sizing apparatus as defined by claim 1 wherein said means for adjustably connecting said responsive workpiece sizing means concentrically and in parallelism to the upper lap plate include a plurality of studs extending vertically between the upper lap plate and said responsive workpiece sizing means including jam nuts threadable upon said studs to either side of said responsive workpiece sizing means.

4. An automatic sizing apparatus as defined by claim 1 wherein said means for adjustably supporting said workpiece sizing assembly includes at least two vertically extending stationary posts extending circumferentially of said responsive workpiece sizing means with said posts positioned circumferentially 180 degrees apart and including means for housing said workpiece sizing assembly along a radius of said responsive workpiece sizing means.

5. An automatic sizing apparatus as defined by claim 4 wherein said means for adjustably connecting said responsive workpiece sizing means concentrically of and in parallelism to the upper lap plate, including a plurality of studs extending vertically between the upper lap plate and said responsive workpiece sizing means and including jam nuts threadable upon said studs to either side of said responsive workpiece sizing means.

6. An automatic sizing apparatus as defined by claim 4 wherein said responsive workpiece sizing means comprises an annular ring having a diameter greater than the upper lap plate so as to extend circumferentially of and in spaced relation to the annular edge of the upper lap plate.

7. An automatic sizing apparatus as defined by claim 4 wherein said responsive workpiece sizing means comprises an annular ring having a diameter greater that the upper lap plate and including a plurality of supporting studs extending vertically between the upper lap plate and said ring for adjustably supporting said ring concentrically of and in parallelism to the upper lap plate, and jam nuts threadable upon said studs to either side of annular ring for mounting the same in spaced parallel relation to the upper lap plate.

8. An automatic sizing apparatus as defined by claim 4 wherein said means for housing said assembly includes a hollow block member having a split end terminating into a transversely extending opening adapted to receive said stationary posts including means for securing said split end of said block in a desired position on said stationary posts, with the opposite end of said block supporting a pivot pin for pivotally supporting said lever, with one end of said lever in constant contact with said sensing probe.

9. An automatic sizing apparatus as defined by claim 8 wherein said responsive workpiece sizing means includes an annular ring having a diameter greater than the upper lap plate so as to extend circumferentially of and in spaced relation to the annular edge of the upper lap plate and within said vertically extending stationary posts.

10. An automatic sizing apparatus as defined by claim 9 wherein said means for adjustably connecting said annular ring concentrically of and in parallelism to the upper lap plate and within said stationary posts include a plurality of circumferentially spaced studs extending between the upper lap plate and said ring and including jam nuts threadable upon said studs to either side of said ring for securing the same in parallelism to the upper lap plate.

11. An automatic sizing apparatus as defined by claim 1 wherein said pivotal lever has a 2:1 end responsive pivotal movement as sensed by said responsive workpiece sizing means.

12. An automatic sizing apparatus as defined by claim 5 wherein said pivotal lever has a 2:1 end responsive pivotal movement sensed by said responsive workpiece sizing means.

13. An automatic sizing apparatus as defined by claim 9 wherein said pivotal lever has a 2:1 end responsive pivotal movement as sensed by said responsive workpiece sizing means.

14. A method of autosizing workpieces being lapped by a machine having rotatable upper and lower lap plates and for compensating for plate runout during the lapping operation comprising the steps of mounting an actuating member in parallelism to the upper lap plate for rotation therewith about a vertical axis, providing a parallelism sensing element having a 2:1 end responsive pivotal movement transmitted thereto by the actuating member during its rotation with the upper lap plate, and placing a vertically moveable probe in contact with one end of the pivotal sensing element so as to be moved thereby and to present a visual readout indicating the continuous reading thickness of the workpiece being lapped as sensed by the pivotal movement of the sensing element.

15. A method of autosizing workpieces being lapped by machine having rotatable upper and lower lap plates and for compensating for plate runout during the lapping operation as defined by claim 14 including the steps of positioning the sensing element along a radial line of the upper lap plate.

* * * * *